US009974365B2

(12) United States Patent
Spahn et al.

(10) Patent No.: US 9,974,365 B2
(45) Date of Patent: May 22, 2018

(54) BUCKLE GUIDE

(71) Applicant: Ford Global Technologies, LLC, Dearborn, MI (US)

(72) Inventors: Brian Robert Spahn, Plymouth, MI (US); Benjamin Yilma, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 340 days.

(21) Appl. No.: 14/535,400

(22) Filed: Nov. 7, 2014

(65) Prior Publication Data

US 2016/0129877 A1 May 12, 2016

(51) Int. Cl.
*A44B 11/25* (2006.01)

(52) U.S. Cl.
CPC ..... *A44B 11/2592* (2013.01); *A44B 11/2523* (2013.01); *A44B 11/2546* (2013.01)

(58) Field of Classification Search
CPC ..... A44B 11/2592; A44B 11/2523; A44B 11/2546
See application file for complete search history.

(56) References Cited

U.S. PATENT DOCUMENTS 4,181,832 A * 1/1980 Ueda ..... A44B 11/2523 200/61.58 B
4,182,008 A * 1/1980 Pouget ..... A44B 11/2523 24/645
4,228,567 A * 10/1980 Ikesue ..... A44B 11/2511 24/642
4,313,246 A * 2/1982 Fohl ..... A44B 11/2523 24/635
4,384,391 A * 5/1983 Lindblad ..... A44B 11/2523 24/633
4,391,023 A * 7/1983 Tanaka ..... A44B 11/2511 24/633
4,404,715 A * 9/1983 Sugimoto ..... A44B 11/2523 24/633
4,624,033 A * 11/1986 Orton ..... A44B 11/2573 24/579.11
4,670,952 A * 6/1987 Ishiguro ..... A44B 11/2523 24/636
4,703,542 A * 11/1987 Hirata ..... A44B 11/2523 24/633
4,731,912 A * 3/1988 Boriskie ..... A44B 11/2576 24/487

(Continued)

FOREIGN PATENT DOCUMENTS

KR 20010004476 1/2001
WO WO 2014025243 A1 * 2/2014 ..... A44B 11/2523

*Primary Examiner* — Jason W San
(74) *Attorney, Agent, or Firm* — Frank A. MacKenzie; Bejin Bieneman PLC

(57) ABSTRACT

A guide mechanism may be provided in a buckle assembly including an inner sleeve and an outer sleeve. The guide mechanism in one example includes notches in the outer sleeve mateable to notches in a tongue piece. In another example, the guide mechanism includes ribs formed on an interior of the outer sleeve, that together with a wall of an outer button included in the outer sleeve, form a slot for receiving a tongue piece. In yet another example, the guide mechanism includes a pair of leaf springs having openings therein forming a slot for receiving a tongue piece.

13 Claims, 6 Drawing Sheets

(56) References Cited

U.S. PATENT DOCUMENTS 4,733,444 A * 3/1988 Takada ..... A44B 11/2523 24/641
4,797,984 A * 1/1989 Seto ..... A44B 11/2523 24/641
4,928,366 A * 5/1990 Ballet ..... A44B 11/2523 24/636
5,014,401 A * 5/1991 Kitazawa ..... A44B 11/2523 24/633
5,054,171 A * 10/1991 Tanaka ..... A44B 11/2523 24/633
5,067,211 A * 11/1991 van Riesen ..... A44B 11/2523 24/633
5,075,937 A * 12/1991 Schneider ..... A44B 11/2523 24/637
5,119,532 A * 6/1992 Tanaka ..... A44B 11/2523 24/639
5,132,880 A * 7/1992 Kawamura ..... A44B 11/2565 280/801.1
5,163,207 A * 11/1992 Krautz ..... A44B 11/2523 24/633
5,216,788 A * 6/1993 Bock ..... A44B 11/2523 24/633
5,357,658 A * 10/1994 Tanaka ..... A44B 11/2523 24/633
5,438,492 A * 8/1995 Collins ..... A44B 11/2523 24/633
5,442,840 A * 8/1995 Ewald ..... A44B 11/2576 24/579.11
5,522,619 A * 6/1996 Collins ..... A44B 11/2503 24/633
5,526,556 A * 6/1996 Czank ..... A44B 11/2511 24/579.11
5,584,108 A * 12/1996 Pleyer ..... A44B 11/2523 24/637
5,685,567 A 11/1997 Koujiya et al.
5,742,987 A * 4/1998 Mikulec ..... A44B 11/2523 24/633
5,907,892 A * 6/1999 Todd ..... A44B 11/2573 24/633
5,996,193 A * 12/1999 Gill ..... A44B 11/2523 24/633
6,035,500 A * 3/2000 Kawai ..... A44B 11/2523 24/633
6,041,480 A * 3/2000 White ..... A44B 11/2576 24/487
6,216,323 B1 * 4/2001 Oyamada ..... A44B 11/2523 24/637
6,233,794 B1 * 5/2001 Kohlndorfer ..... A44B 11/2523 24/633
6,367,129 B1 * 4/2002 Mori ..... A44B 11/2523 24/171
6,370,742 B1 * 4/2002 Yamaguchi ..... A44B 11/2523 24/633
6,701,587 B1 * 3/2004 Sato ..... A44B 11/2523 24/633
6,725,509 B1 * 4/2004 Lee ..... A44B 11/2523 24/641
6,895,643 B2 * 5/2005 Itoigawa ..... B60R 22/48 24/633
6,907,646 B2 * 6/2005 Lee ..... B60R 22/48 180/268
6,988,297 B2 * 1/2006 Willard ..... A44B 11/2576 24/633
7,240,407 B2 * 7/2007 Kawai ..... A44B 11/2523 24/640
7,370,393 B2 * 5/2008 Hlavaty ..... A44B 11/2523 24/633
8,215,716 B2 7/2012 Akaike et al.
8,393,061 B2 * 3/2013 McGlynn ..... A44B 11/2576 24/198
8,402,617 B2 * 3/2013 Wang ..... A44B 11/2523 24/629
8,950,780 B2 * 2/2015 Betz ..... A44B 11/2515 24/633
9,346,433 B2 * 5/2016 You ..... A44B 11/2523
2001/0037544 A1 * 11/2001 Rogers, Jr. ..... A44B 11/2523 24/641
2002/0092141 A1 * 7/2002 Rohrle ..... A44B 11/2523 24/641
2002/0178557 A1 * 12/2002 Katsuyama ..... A44B 11/2523 24/633
2004/0078944 A1 * 4/2004 Staub ..... A44B 11/2523 24/633
2005/0086777 A1 * 4/2005 Kawai ..... A44B 11/2523 24/633
2005/0207837 A1 * 9/2005 Kosh ..... A44B 11/2592 403/327
2006/0285344 A1 * 12/2006 Kohama ..... A44B 11/2523 362/483
2007/0084026 A1 * 4/2007 Muromachi ..... A44B 11/2523 24/636
2007/0107173 A1 * 5/2007 Yamada ..... A44B 11/2523 24/636
2007/0193008 A1 * 8/2007 Sugita ..... A44B 11/2523 24/641
2007/0289111 A1 * 12/2007 Mandarino ..... A44B 11/2576 24/633
2008/0016660 A1 1/2008 Riddle
2008/0040905 A1 * 2/2008 Webber ..... A44B 11/2523 24/633
2009/0314618 A1 * 12/2009 Midorikawa ..... A44B 11/2523 200/238
2010/0281660 A1 * 11/2010 Lee ..... A44B 11/2523 24/593.1
2010/0314930 A1 * 12/2010 Akaike ..... A44B 11/2523 297/468
2011/0146034 A1 * 6/2011 Ng ..... A44B 11/2523 24/640
2012/0174353 A1 * 7/2012 Lee ..... A44B 11/2523 24/593.1
2012/0233822 A1 * 9/2012 Wang ..... A44B 11/2523 24/633
2013/0174390 A1 * 7/2013 Muromachi ..... A44B 11/2523 24/633
2013/0263411 A1 * 10/2013 Jagodzinski ..... B60R 22/48 24/633
2014/0132056 A1 5/2014 Yilma
2014/0208549 A1 * 7/2014 McGlynn ..... A44B 11/2576 24/633
2015/0166005 A1 * 6/2015 You ..... A44B 11/2523 24/642
2015/0173461 A1 * 6/2015 Okano ..... A44B 11/2561 24/593.1
2015/0296928 A1 * 10/2015 Krauss ..... B60Q 3/004 362/549
2015/0320148 A1 * 11/2015 Bevilacqua ..... A44B 11/2592 24/634
2016/0135548 A1 * 5/2016 Kawai ..... A44B 11/2546 297/474

* cited by examiner

BUCKLE GUIDE

BACKGROUND

Vehicle occupants can have difficulty in accessing and securing seatbelt buckles. Safety needs usually dictate the use of a short buckle to minimize seatbelt slack and encourage early and stiff engagement of the seatbelt on the pelvis. Unfortunately, while best for safety performance, a short buckle is typically difficult to locate and align with a seatbelt tongue while a vehicle occupant is donning the seatbelt. Although electric seatbelt buckle presenters can improve buckle accessibility, these systems are very expensive and therefore not practical for all but a few luxury vehicles. Accordingly, a seatbelt buckle system having improved accessibility is needed.

DRAWINGS

DESCRIPTION

Figure 1:
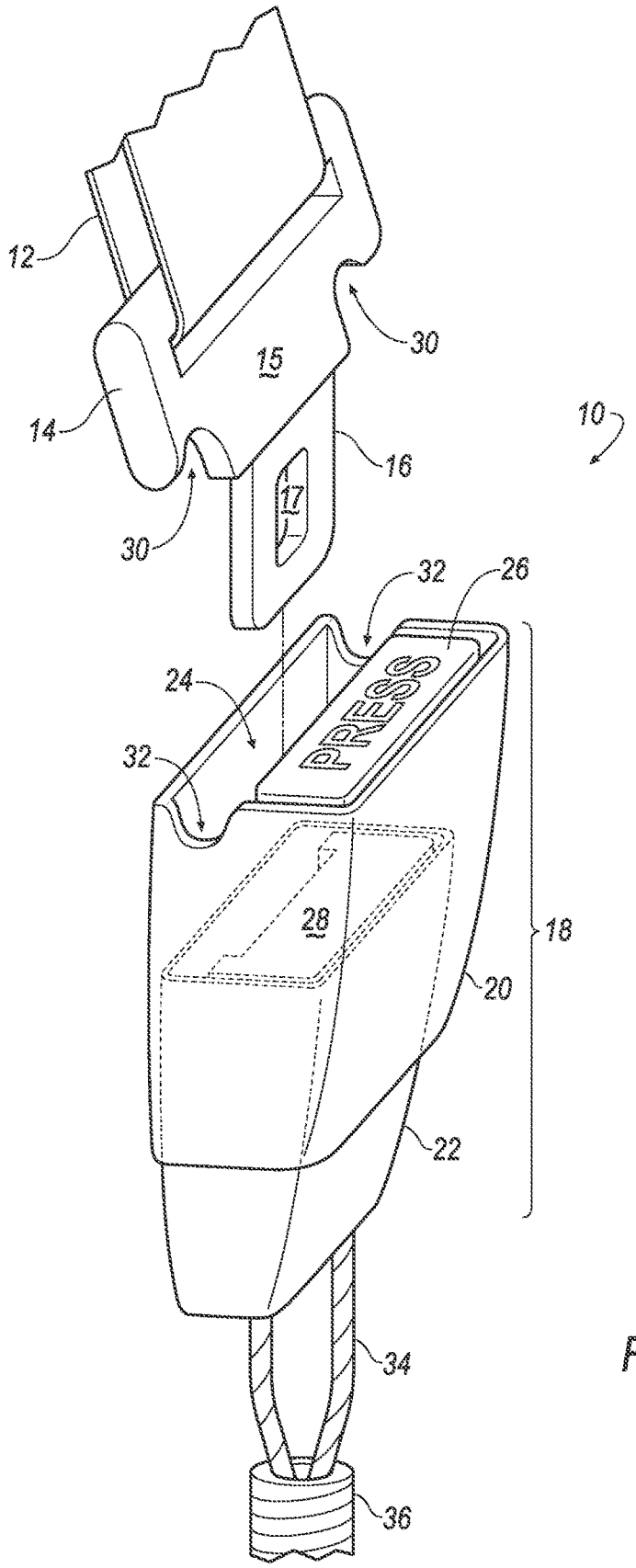
FIG. 1 is a perspective view of a first example of a buckle system.

Disclosed herein are mechanisms for guiding a tongue into a buckle. FIG. 1 is a perspective view of a buckle system 10. A seatbelt 12 is secured to a tongue piece 14 in a conventional manner. The tongue piece 14 includes a conventional latch plate 16 having a latch opening 17 that may be used to secure the tongue 14 to a buckle in a known manner. A receiving assembly includes an outer sleeve 20 mounted over an inner sleeve 22. Components described herein are generally made of known materials in a known manner, e.g., the sleeves 20, 22 may be formed of molded plastic or the like, the tongue piece 14 may include metal and/or plastic, e.g., the latch plate 16 may be formed of metal, etc.

The sleeve 22 serves as a cover for a buckle mechanism, not shown inasmuch as the buckle mechanism is known for receiving and securing the latch plate 16, as just mentioned. The sleeve 22 may receive a tether 34 that is attached to an anchor 36 in a known manner at a first end, and to a buckle mechanism at a second end. An outer button 26, secured to the outer sleeve 20, may contact an inner button 28 that is secured to the inner sleeve 22 for releasing the buckle mechanism after the latch plate 16 has been secured. As described further below with respect to FIGS. 6-8, springs and/or dampers may be provided in the receiving assembly 18 to tension the outer sleeve 20 with respect to the inner sleeve 22, and/or to urge the outer sleeve 20 upward with respect to the inner sleeve 22. For example, such tensioning may cause a top side of the outer sleeve 20 to be urged away from a top side of the inner sleeve 22, in a controlled manner when the buttons 26, 28 are depressed to release the latch plate 16 from the buckle mechanism.

The outer sleeve 20 includes a receiving slot 24 for receiving the latch plate 16. Note that a spring loaded door or other known mechanism could be provided to cover the slot 24 to prevent contaminants from entering the slot 24 when the tongue 16 is not inserted in the slot 24. Notches 30 are provided on the tongue piece 14, the notches 30 being arranged to be received by notches 32 included in sides of the outer sleeve 20 such that the notches 30, 32 are a guide mechanism. For example, the notches 30 may be formed in a side of the tongue piece 14 facing in a direction in which the tongue latch plate 16 extends, and in a plane substantially defined by an upper portion 15 of the tongue piece 14. Further, the notches 32 may be formed in planes defined by sides of the outer sleeve 20 such that planes of the notches 30 and 32, respectively, are substantially perpendicular to one another. In addition, the sides of the outer sleeve 20 and/or planes thereof including the notches 32 are substantially perpendicular to a longitudinal axis of the slot 24. Moreover, the notches 30, 32 may be curved, e.g., substantially semi-circular, in shape. However, other shapes, e.g., half-rectangles or the like, are possible; the notches 30, 32 should generally be configured to be interlocking. Thus, when a vehicle occupant inserts the tongue piece 14 into the receiving slot 24, edges of the notches 30, 32 may contact each other and serve to guide the tongue piece 14, including the latch plate 16, and to provide alignment of the plate 16 in the slot 24 for securing by the buckle mechanism.

Figure 2:
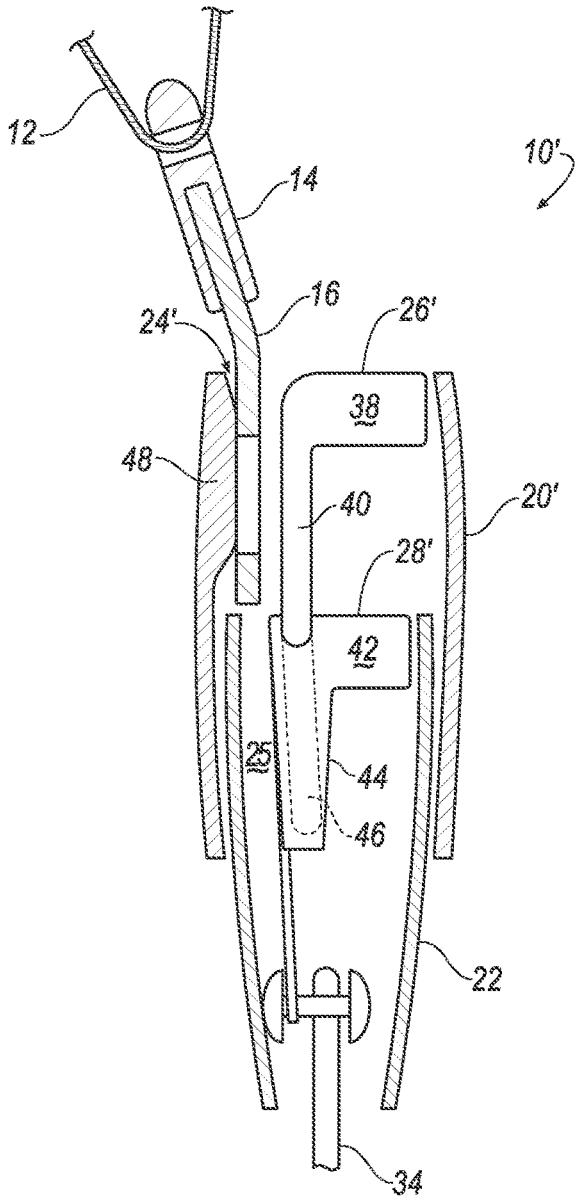
FIG. 2 is a side cross-sectional view of a second example of a buckle system.
Figure 3:
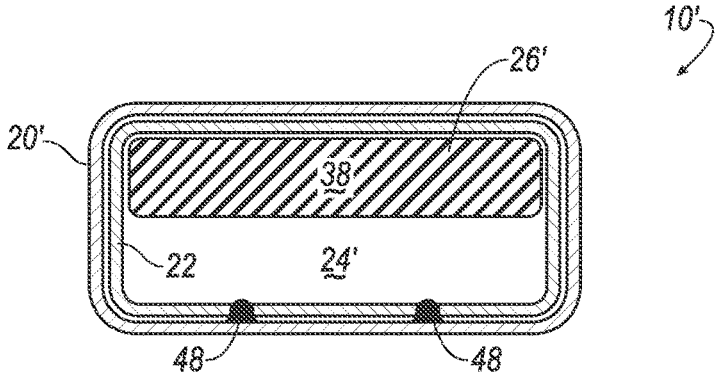
FIG. 3 is a top view of the buckle system of FIG. 2.

FIG. 2 is a side-cross-sectional view of a second example of a buckle system 10', and FIG. 3 is a top view of the buckle system of FIG. 2. As can be seen, in these figures the system 10' includes like elements discussed above with respect to the system 10; such elements need not be described again with respect to the system 10'.

Further, the system 10' includes an outer sleeve 20' that surrounds the inner sleeve 22. The sleeve 20' has a plurality longitudinal ribs 48 formed on an interior surface of the sleeve 20', and extending substantially from a top edge of the interior surface of the sleeve 20' to a location that is generally one-third to one-half the longitudinal distance of the sleeve 20'. In general, a length of the ribs 48 is selected to be sufficient to guide the latch plate 16 in a receiving slot 24' as described further below; the ribs 48 generally end at or before a point where the outer sleeve 20' overlaps the inner sleeve 22.

An outer button 26' is disposed in the sleeve 20' above and inner button 28', the inner button 28' being disposed in the sleeve 22. The outer button 26' is generally L-shaped, including a lateral portion 38 and a descending portion 40. The inner button 28' is also generally L-shaped, having a lateral portion 42 and a descending portion 44. The descending portion 44 of the inner button 28' includes a receiving slot 46 for receiving the descending portion 40 of the outer button 26'. After a buckle mechanism disposed in the inner sleeve 22 has secured the latch plate 16, the outer button 26' may be pressed downward to contact the inner button 28', which in turn may be urged downward to release the latch plate 16 from the buckle mechanism (not shown because the buckle mechanism is known and operates with the latch plate 16 in a conventional manner).

As mentioned above, the system 10' includes a receiving slot 24' for receiving the latch plate 16. The receiving slot 24' is defined by the ribs 48 and a side of the descending portion 40 of the outer button 26' that faces the ribs 48. Thus, when the tongue piece 14 including the latch plate 16 is inserted into the slot 24', the ribs 48 serve to guide the latch plate 16 into a buckle slot 25 in the inner sleeve 22. The buckle slot 25 is generally defined by an interior surface of the buckle sleeve 22 and a face of the descending portion 44 of the inner button 28'. When a vehicle occupant is attempting to buckle a seatbelt, the receiving slot 24', including the ribs 48, serves to guide the tongue latch plate 16 toward the buckle slot 25, and the buckle slot 25 serves to guide the latch plate 16 toward the buckle mechanism used to secure the latch plate 16, whereby the ribs 48 and the descending portion 44 are a guide mechanism.

Figure 4:
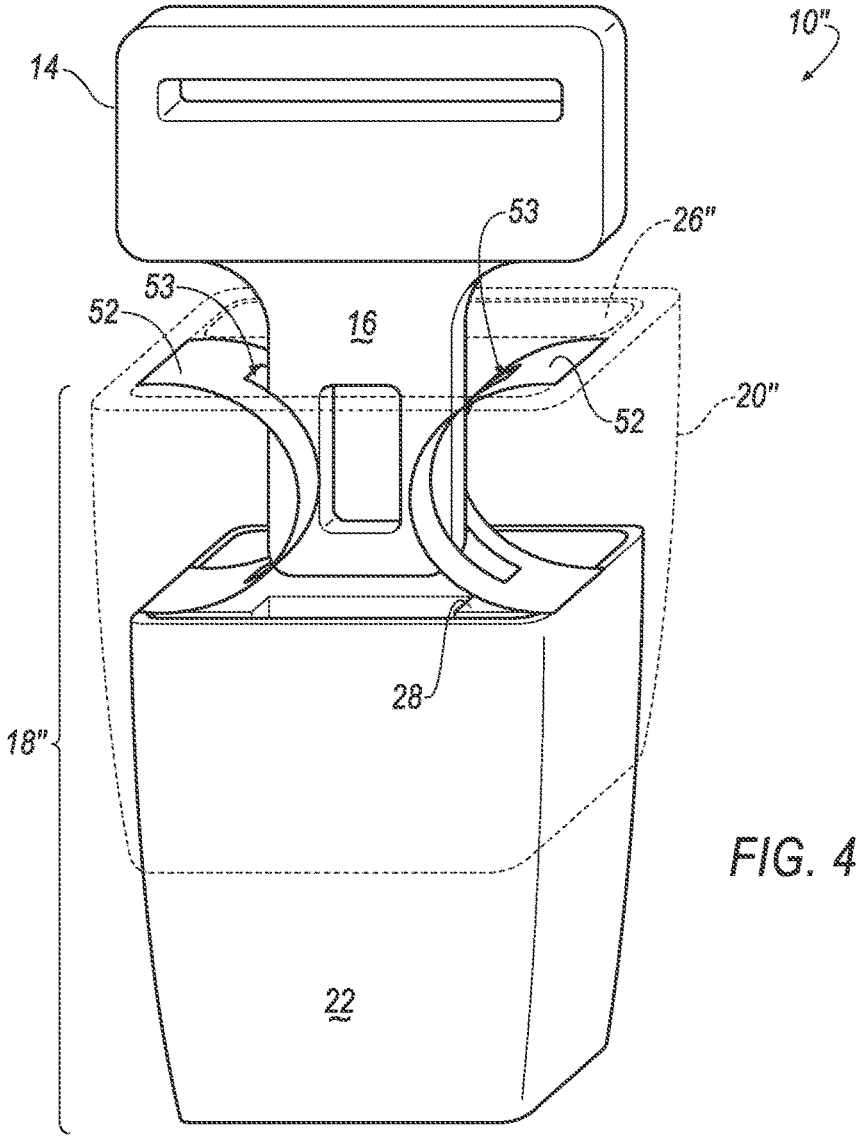
FIG. 4 is a perspective view of a third example of a buckle system.
Figure 5:
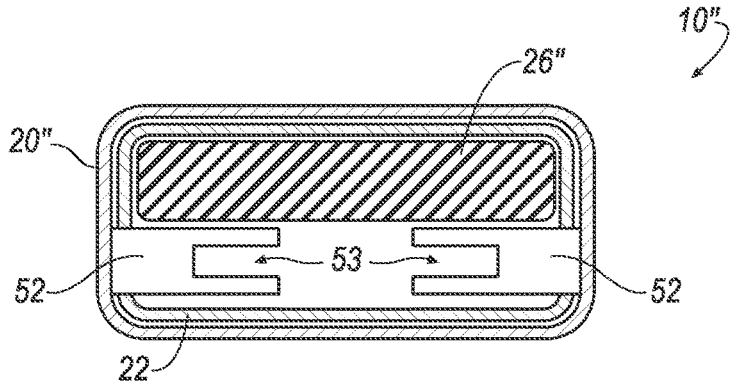
FIG. 5 is a top view of the buckle system of FIG. 4.

FIG. 4 is a perspective view of a third example of a buckle system 10". FIG. 5 is a top view of the buckle system 10". Again, like elements discussed above with respect to the system 10 need not be described again with respect to the system 10". As can be seen in FIG. 4, and outer sleeve 20" has disposed therein a pair of leaf springs 52 that each include an opening 53. The leaf springs 52 are generally secured to a top side edge of the outer sleeve 20" at a first end, with a second end resting on an inner button 28 attached to the inner sleeve 22. The leaf springs 52 generally have a width extending from a front interior surface of the sleeve 20" to a side of an outer button 26".

The outer sleeve 20" may be secured to the inner sleeve 22 such that the openings 53 of the leaf springs 52 form slots for receiving the tongue latch 16 even when the buckle assembly 18" is in a relaxed position, i.e., the buckle mechanism in the inner sleeve 22 is not securing the tongue latch 16, and the outer sleeve 20" is urged away from the inner sleeve 22, e.g., by the leaf springs 52. Accordingly, slots formed in the openings 53 serve to guide the tongue latch plate 16 toward the buckle mechanism, for example, facilitating buckling a seatbelt for a vehicle occupant, whereby the leaf springs 52 including the openings 53 are a guide mechanism for the tongue latch plate 16.

Figure 9A:
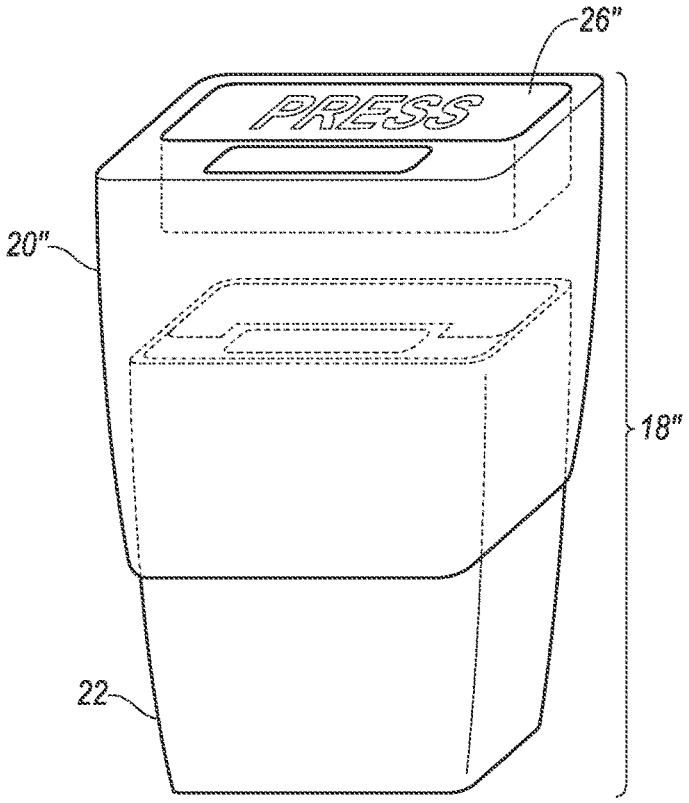
FIGS. 9A and 9B are perspective views of receiving assemblies including respective exemplary outer buttons for releasing buckle.
Figure 9B:
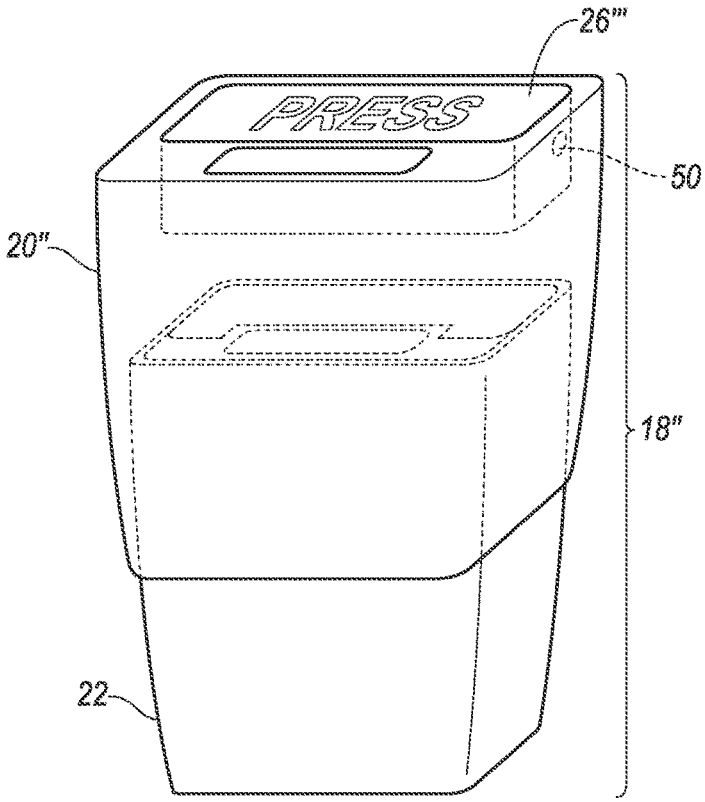

As seen in FIG. 9A, an outer button 26" included in the outer sleeve 20" of an assembly 18" may be secured to the outer sleeve 20" in a fixed manner. Accordingly, when the button 26" is pressed, urging the outer sleeve 20" toward the inner sleeve 22, the button 26" moves downward until it contacts the inner button 28, which in turn causes a buckle mechanism to release the tongue latch 16. In a variation seen in FIG. 9B, a movable outer button 26'" included in the outer sleeve 20" may be pivotably affixed to the outer sleeve 20", e.g., using a pin 50 or other mechanism allowing the button 20" to pivot with respect to the outer sleeve 20". The button 26'" may have an angled or curved bottom side such that pivoting the button 26'", possibly in conjunction with pressing downward toward the inner sleeve 22, contacts and causes depression of the inner button 26. Alternatively or additionally, the moveable button 26'" may be provided with a vertical translation, e.g., at an axis defined by a pin or pins 50 such that the button 26'" may be moved up and down with respect to the outer sleeve 20" to effect contact with the inner button 28.

Figure 6:
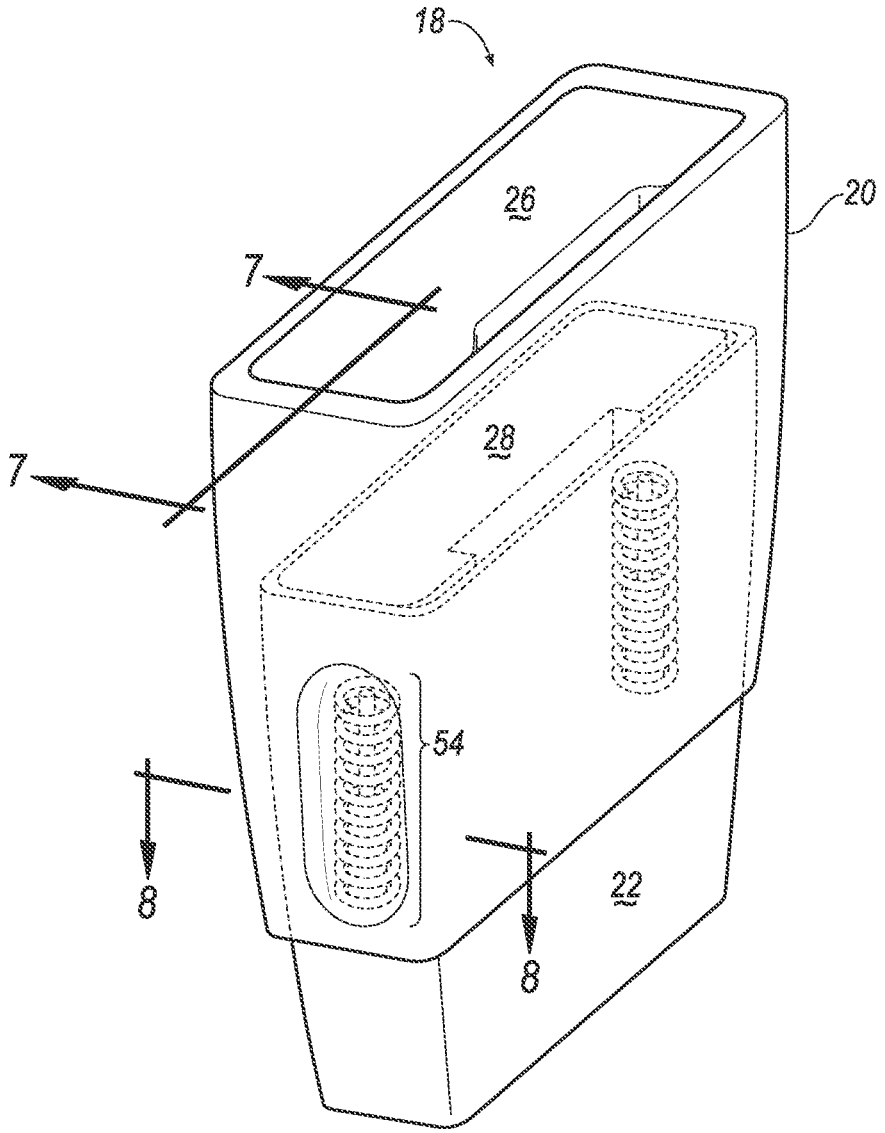
FIG. 6 is a perspective view of an exemplary buckle assembly including a tensioning mechanism.
Figure 7:
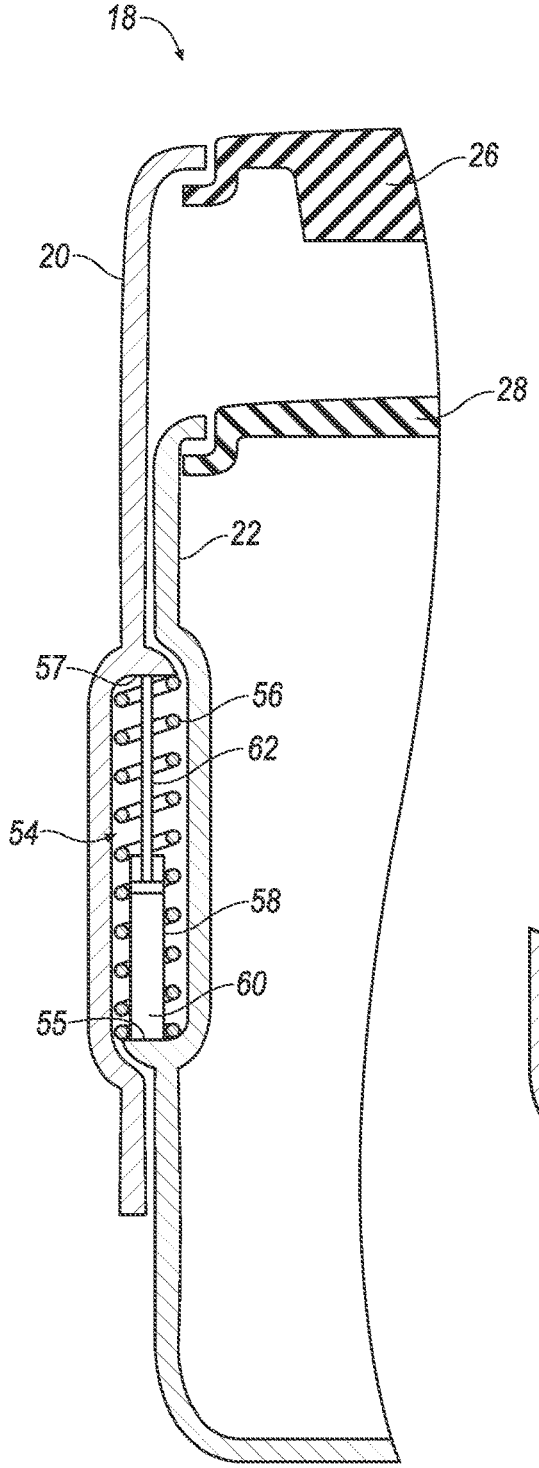
FIG. 7 is a side cross-sectional view of the buckle assembly of FIG. 6 including the tensioning mechanism.
Figure 8:
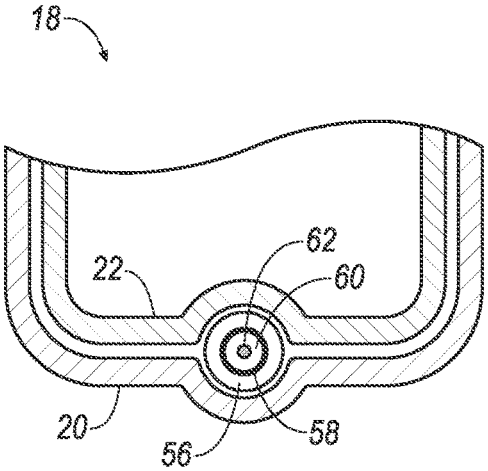
FIG. 8 is a partial top cross-sectional view of the buckle assembly of FIG. 6 including the tensioning mechanism.

As mentioned above, the buckle assemblies 18, 18', 18", may include a mechanism to urge apart the outer sleeve 20 and inner sleeve 22 as well as to damp the effect of releasing a tongue latch 16 from a buckle mechanism. FIG. 6 is a perspective view of a buckle assembly 18 including an exemplary tensioning mechanism 54; FIG. 7 shows a side cross-sectional view, and FIG. 8 shows a top cross-sectional view. The tensioning mechanism 54 includes a coil spring 56 disposed between a shelf 55 that may be formed in a side wall of the inner sleeve 22, and a facing shelf 57 that may be formed in a side wall of the outer sleeve 20. A damper 58 including a damper cylinder 60 and a piston 62 is disposed within the coil spring 56. The damper 58 may use a variety of known mechanisms, e.g., the cylinder 60 may operate via friction, pneumatic, or oil-filled damping.

When an outer button 26 is pressed and thus urged toward the inner button 28, carrying with it the outer sleeve 20 moving with respect to the inner sleeve 22, the coil spring 56 which provides tension urging the buttons 26, 28 apart, is compressed. The coil spring 56 remains in a compressed state when the latch 16 is secured by a buckle mechanism. However, when the buckle mechanism is released, the coil spring 56 decompresses, urging the buttons 26, 28 apart, i.e., moving the outer sleeve 20 in a direction away from the buckle mechanism with respect to the inner sleeve 22. The damper 58 is provided to reduce the suddenness and/or force with which the outer sleeve 20 moves, thereby avoiding startling or annoying a vehicle occupant releasing a buckle.

As used herein, the adverb "substantially" means that a shape, structure, measurement, quantity, time, etc. may deviate from an exact described geometry, distance, measurement, quantity, time, etc., because of imperfections in materials, machining, manufacturing, etc.

In the drawings, the same reference numbers indicate the same elements. Further, some or all of these elements could be changed. With regard to the components, processes, systems, methods, etc. described herein, it should be understood that these are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their plain and ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

The invention claimed is:

1. A buckle system, comprising:

an inner sleeve having four sides forming a completely enclosed shape;

an outer sleeve fittable over the inner sleeve;

an inner release button secured to the inner sleeve, the inner release button including an inner button descending portion, the inner button descending portion having a slot extending toward a seatbelt anchor; and an outer release button secured to the outer sleeve, the outer release button including an outer button descending portion receivable in the slot of the inner button descending portion;

wherein the outer button descending portion is arranged to move the inner release button toward the seatbelt anchor when the outer button descending portion is received in the slot of the inner button descending portion.

2. The system of claim 1, further comprising a tongue piece including a tongue latch plate, wherein the inner sleeve further includes a buckle slot, the tongue latch plate being receivable by the buckle slot.

3. The system of claim 2, wherein the tongue latch plate is arranged to disengage from the buckle slot when the slot receives the outer button descending portion.

4. The system of claim 1, further comprising a tensioning mechanism arranged to urge a top side of the outer sleeve away from a top side of the inner sleeve.

5. The system of claim 4, wherein the tensioning mechanism includes a damping mechanism.

6. The system of claim 1, further comprising a tongue piece and a seat belt connected to the tongue piece.

7. The system of claim 1, wherein the outer release button is slidably mounted on the outer sleeve.

8. The system of claim 1, wherein the outer release button is fixedly mounted on the outer sleeve.

9. The system of claim 1, wherein the outer release button is pivotably mounted on the outer sleeve.

10. The system of claim 1, wherein the outer release button includes a lateral portion, the descending portion extending transverse to the lateral portion.

11. The system of claim 1, wherein the inner release button includes a lateral portion, the descending portion extending transverse to the lateral portion.

12. The system of claim 1, further comprising at least one rib disposed on the outer sleeve.

13. The system of claim 12, wherein the rib is arranged to guide a tongue piece into a buckle slot disposed in the inner sleeve.

* * * * *